US006415641B1

(12) United States Patent
Wagner

(10) Patent No.: US 6,415,641 B1
(45) Date of Patent: Jul. 9, 2002

(54) DEVICE FOR APPLYING A PRESSING FORCE

(75) Inventor: Rudolf Wagner, Stuttgart (DE)

(73) Assignee: REMS -WERK Christian Föll und Söhne GmbH & Co., Waiblingen (DE)

( * ) Notice: Subject to any disclaimer, the term of this patent is extended or adjusted under 35 U.S.C. 154(b) by 0 days.

(21) Appl. No.: 09/580,332

(22) Filed: May 26, 2000

(30) Foreign Application Priority Data

May 28, 1999 (DE) ..... 199 24 509
Oct. 15, 1999 (DE) ..... 199 49 797

(51) Int. Cl.[7] ..... B21D 37/04
(52) U.S. Cl. ..... 72/393; 72/453.16
(58) Field of Search ..... 29/252; 72/453.15, 72/453.16, 453.17, 393

(56) References Cited

U.S. PATENT DOCUMENTS 4,494,398 A * 1/1985 Svoboda ..... 72/453.16
5,195,354 A * 3/1993 Yasui et al. ..... 72/453.16
5,727,417 A * 3/1998 Moffatt et al. ..... 72/453.16

* cited by examiner

*Primary Examiner*—Lowell A. Larson
(74) *Attorney, Agent, or Firm*—Gudrun E. Huckett

(57) ABSTRACT

An electric tool for applying a pressing force has a tool housing and a drive arranged in the tool housing. The drive has an electric motor and a drive element configured to be driven by the electric motor. The drive element is located externally to the tool housing. A pressing unit is connected to the drive element remote from the tool housing and has two pressing parts. The drive element acts on at least one of the two pressing parts for moving the at least one pressing part relative to the other one of the two pressing parts. The drive element is preferably a hydraulically actuated piston, and the electric motor operates a pump element that supplies hydraulic medium to the piston.

55 Claims, 7 Drawing Sheets

1
2
5
7
9
10
11
12
13
14
15
α
40

1
2
3
4
5
6
7
8
12
13
14
15
16
17
18
19
20
21
22
23
24
25
26
27
28
29
30
31
32
33
34
35
36
37
38
39
40
44
50
52
53
55
57
58
82
85

DEVICE FOR APPLYING A PRESSING FORCE

BACKGROUND OF THE INVENTION

1. Field of the Invention

The invention relates to a device for applying a pressing force, comprising a housing in which a drive is arranged that has a motor and a drive element driven by the motor, and further comprising a pressing unit with two pressing parts wherein at least one of the two pressing parts is moved relative to the other pressing part during the pressing action.

2. Description of the Related Art

It is, for example, known to connect pipes fixedly to one another by pressing them together. In this context, radial as well as axial pressing techniques are employed. According to the radial pressing technique, a press fitting with inner or outer positioned sealing ring is manually inserted into the pipe or placed onto the pipe. The press fitting is then radially pressed by means of a device in the form of pressing pliers.

According to the axial pressing technique it is known to employ a press fitting comprised of a support sleeve and a pressure sleeve. In order to connect pipes to one another, one pipe is first widened before the press fitting can be inserted into the widened pipe end. This additional widening process is complex and requires an additional working step. The pressing sleeve is pressed by means of the device axially against the stop on the fitting. In another axial pressing technique, a pressing ring and a squeeze ring are slipped over the pipe. A support sleeve (fitting) is inserted into the pipe and the pressing ring is pressed by means of the device axially across the squeeze ring until it reaches the stop on the support ring. In this technique a prior widening of the pipe is not needed.

Devices are known which have two arms projecting from the base member and having at their free ends each a pressing part. The free ends of the arms are connected to one another by a spindle which can be rotated by means of a ratchet spanner. In this context, one arm is pivoted relative to the other arm. Because of this pivot movement, one pressing part moves along a circular arc which may result in problems during the pressing action on a straight pipe.

Moreover, a manually operated pressing device is known which operates similar to a pair of pliers. It has actuating arms which during the axial pressing process are pivoted back an forth relative to one another wherein a chain or a ratchet moves one of the pressing parts in the direction toward the other pressing part. This device has large dimensions and its use is cumbersome.

Moreover, a device is known in which one pressing part is provided on a sliding sleeve which can be moved by a hydraulic medium on the pipe piece in the direction toward the other pressing part. From one end of the pipe piece a further pipe piece projects perpendicularly via which the hydraulic medium is supplied. A hydraulic hose is connected to the free end of this further pipe piece which is connected to a hydraulic device arranged in the room. A grip projects perpendicularly from this further pipe piece and the device is held by this grip. Due to the described configuration, the device can be carried only with difficulty because the grip is arranged at the one end and the pipe piece support for the pressing parts is arranged at the other end of the pipe. Accordingly, a considerable force expenditure is required in order to hold the device during the pressing process.

Further pressing devices are configured as sliding pliers in which the pressing parts also perform a pivot movement which results in problems for straight pipes.

It is also known to convert such a pivot movement by an additional lever mechanism into a straight movement of the pressing parts. However, the constructive expenditure of such a device is high. Especially, the weight of such a pressing device, because of the additional lever mechanism, is greatly increased so that the manipulation during the pressing process is made much more difficult.

SUMMARY OF THE INVENTION

It is an object of the present invention to configure the device of the aforementioned kind such that it has a simple design and provides a simple manipulation while ensuring a flawless pressing result.

In accordance with the present invention, this is achieved in that the device is an electric tool and that first the drive element and then the pressing unit are connected to the tool housing of the electric tool in series.

The device according to the invention is embodied as an electric tool in which the housing, the drive element for at least one of the pressing parts, and the pressing unit are arranged in series to one another. This results in a constructively simple configuration. Because of the position of the individual. parts, the device according to the invention can be of a compact configuration. Moreover, with this configuration an optimal weight distribution of the device is provided so that it can be held effortlessly during the pressing action.

DESCRIPTION OF THE PREFERRED EMBODIMENTS

The device disclosed in the following in detail is used primarily in sanitary engineering for connecting pipes, pipe pieces etc. to one another in a non-detachable way. This includes a plastic deformation process which provides the fixed connection. Depending on the configuration of the device a radial or an axial pressing technique is used. According to the radial pressing technique pipes, pipe pieces, fittings etc. are inserted into one another and a radial pressing is performed by the device in the area of insertion. According to the axial pressing technique, the device axially moves a pressing ring onto the pipe, pipe piece, fitting so that by means of the pressing ring a radial plastic deformation takes place.

Figure 1:
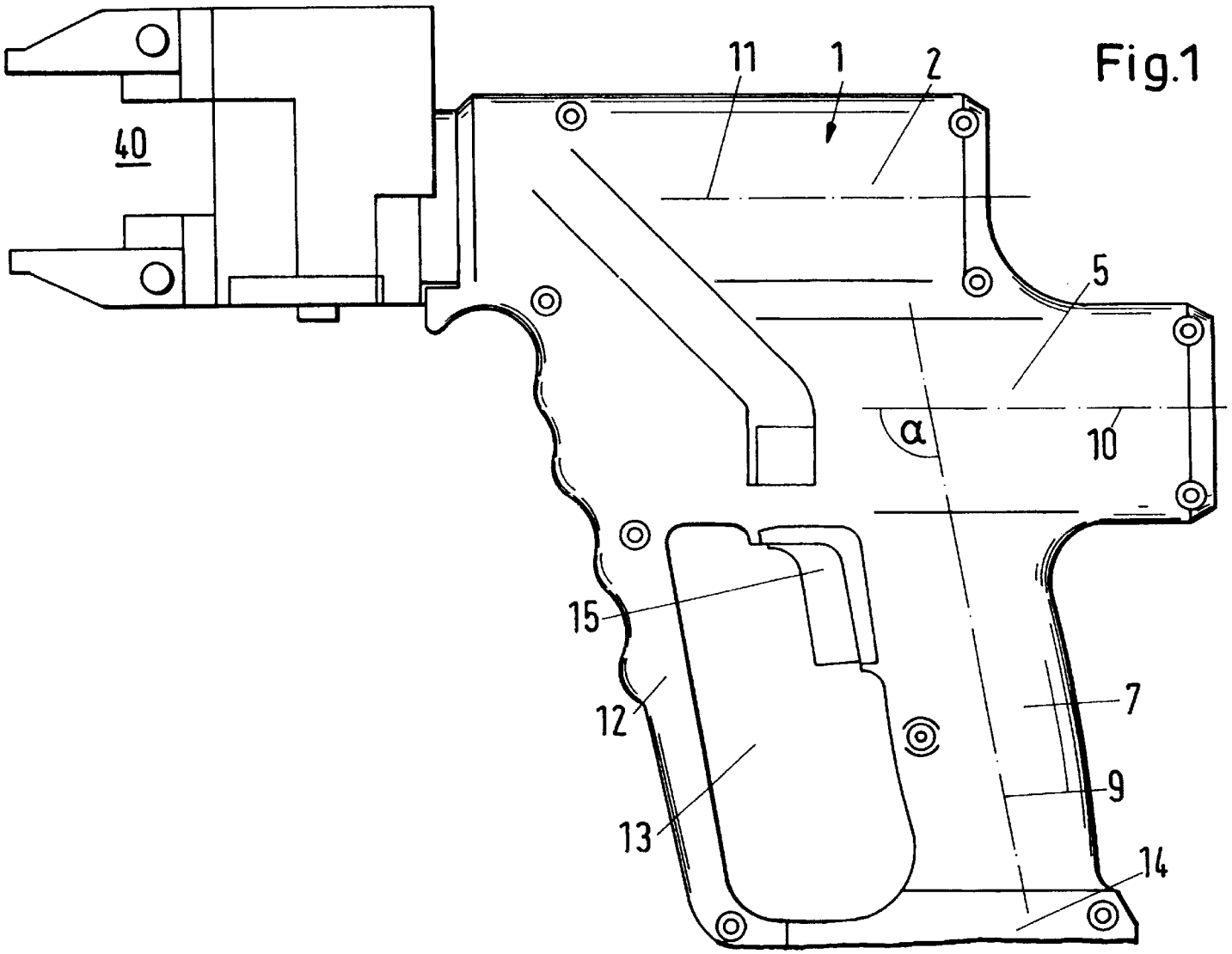
FIG. 1 is a side view of the device according to the invention for pressing workpieces.

In the embodiment according to FIGS. 1 through 4, the device is a portable tool which can be carried comfortably by the operator. The device has a tool housing 1 which is advantageously comprised of two detachably connected housing parts. Of course, the tool housing 1 can also be comprised of more than two housing parts. The tool housing 1 is pistol-shaped and has an elongate housing part 2 in which a hydraulic part 3 (FIG. 2) of a drive 4 is arranged. Below the housing parts 2 a housing part 5, that is longer in the axial direction, is positioned in which a mechanical part 6 of the drive 4 is arranged. A grip 7 projects transversely from the housing part 5 which is also a portion of the tool housing 1 and in which an electric/electronic part 8 of the drive 4 is positioned. The grip 7 is recessed relative to the housing part 5. The longitudinal axis 9 of the grip 7 is positioned at an obtuse angle $\alpha$ relative to the longitudinal axis 10 of the housing part 5. The longitudinal axis 10, in turn, is positioned parallel to the longitudinal axis 11 of the housing part 2 (FIG. 1). In front of the grip 7 a hollow stay 12 is provided which extends approximately parallel to the longitudinal axis 9 of the grip 7 and is spaced from it. This creates the grip opening 13 between the grip 7 and the stay 12. The stay 12 and the grip 7 are connected to one another by an integral transverse piece 14 which is also formed as a hollow part.

Figure 2:
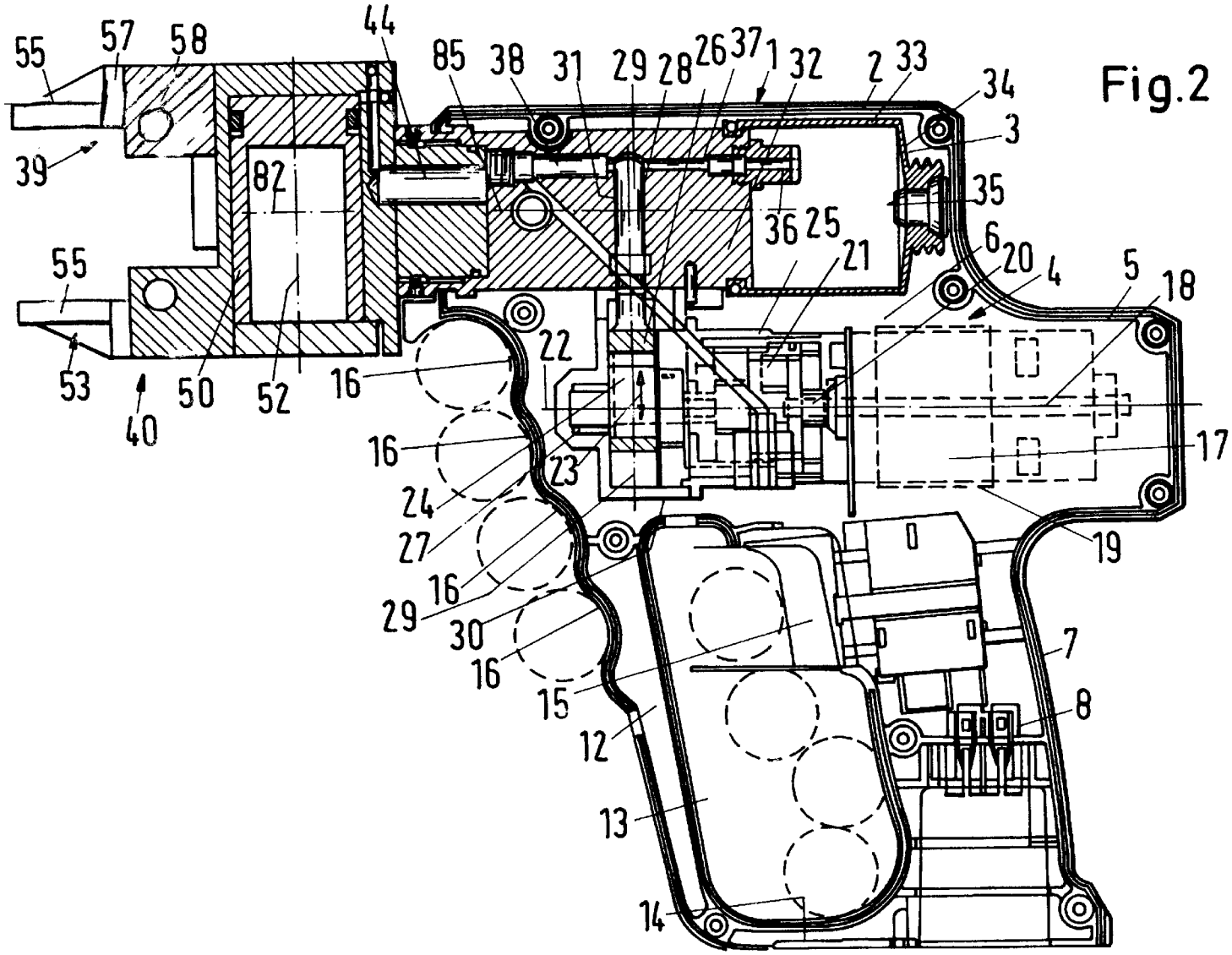
FIG. 2 is a sectional view of the device according to the invention shown in FIG. 1.

During the pressing action, the device is preferably held by the grip 7, wherein the operator grips the grip 7, as indicated in FIG. 2 by dash circles. The hand of the user extends thus through the grip opening 13. The stay 12 protects the hand of the user during the pressing process. At the transition of the grip 7 to the housing part 5 a switch 15 projects from the grip 7 into the grip opening 13. When gripping the grip 7, the switch 15 can be easily squeezed by the index finger in order to turn on the drive 4. The switch 15 can be configured such that it must be constantly squeezed during the pressing action. As soon as the switch 15 is released, the drive 4 is turned off. However, it is also possible to configure the switch 15 such that it is only squeezed once for turning on the drive 4 and then squeezed a second time for turning off the drive 4. This latter embodiment has the advantage that the operator must not squeeze the switch 15 during the entire time of the pressing process. In this case, the device can also be gripped such that the hand grips the grip 7 and the stay 12, as indicated in FIG. 2 by further dash circles. In order to provide in this scenario a safe grip for the hand, the housing part 5 as well as a portion of the stay 12 at a side facing a way from the grip 7 are provided with grip depressions 16 so that the fingers can securely hold onto the tool housing 1.

The transverse piece 14 of the tool housing 1 can be a receptacle for at least one accumulator or a battery. The device can also be operated by current supplied from the mains supply. In this case, an electric cable (not shown) extends from the tool housing 1, preferably downwardly from the transverse piece 14.

The electric/electronic part 8 of the drive 4 is arranged within the narrow grip 7 to thereby save space. The electric/electronic part 8 switches on and off the mechanical drive part 6. This drive part 6 comprises an electric motor 17 whose axis 18 extends parallel to the longitudinal axis 10 and advantageously coincides with this longitudinal axis. The motor shaft 20 projecting from the motor housing 19 is coupled to the reducing gear unit 21 arranged downstream which is advantageously configured as a planetary gear unit. The reducing gear unit 21 is advantageously at least of a two-step design. The preferred use of a planetary gear unit as the reducing gear unit 21 has the advantage that only minimal space is required while a high reducing gear ratio is provided. Accordingly, the reducing gear unit 21 can be arranged in a space saving way within the housing part 5. The longitudinal axis 22 of the reducing gear unit 21 is advantageously arranged so as to be aligned with the longitudinal axis 18 of the motor 17.

The drive shaft 23 of the reducing gear unit 21 supports an eccentric piece 24 external to the housing 25 of the reducing gear unit 21. An elliptical ring 26 is positioned with or without interposition of an intermediate ring on the eccentric piece 24. The longer axis of this elliptical ring 26 extends transversely to the axis of the drive shaft 23, i.e., transversely to the plane of the drawing, while the smaller axis is positioned with in the plane of the drawing according to FIG. 2. The eccentric piece 24, or the round intermediate ring seated on it, rests against the inner wall of the portions of the ring 26 extending perpendicularly to the plane of the drawing. When the drive shaft 23 is rotated about its axis, the ring 26 is moved up and down by means of the eccentric piece 24 in the direction of the double arrow 27 in FIG. 2 within the plane of the drawing. Such an eccentric drive is known and is therefore not explained in detail in this context.

The elliptical ring 26 supports a piston 28 which is preferably a unitary part of the ring 26 but can also be fixedly connected thereto. The piston 28 projects with play all around from the housing 30, which receives the eccentric drive 23, 24, 26, into a piston chamber 31 which is advantageously formed by a bore in a hydraulic unit 32. It is arranged in the housing part 2 of the tool housing 1 and supported on the housing 30 of the eccentric drive 23, 24, 26 and fastened thereto. At one end of the hydraulic unit 32, a reservoir 33 for a hydraulic medium, preferably a hydraulic oil, is provided. A closable filling opening 35 is provided on the bottom 34 of the hydraulic medium reservoir 33 positioned opposite the hydraulic unit 32 via which hydraulic medium can be filled into the hydraulic medium reservoir 33. A check valve 36 projects into the hydraulic medium reservoir 33 which closes a bore 37, extending transversely to the piston chamber 31, relative to the hydraulic medium reservoir 33. The bore 37 having a smaller flow cross-section then the piston 31 opens into the piston chamber 31 at the chamber end remote from the eccentric drive 23, 24, 26. In this area a supply bore 38 opens also into the piston chamber 31. This bore 38 is also provided within the hydraulic unit 32 and extends transversely to the piston chamber 31 and is advantageously aligned with the bore 37. The supply bore 38 supplies the hydraulic medium for actuating a pressing part 39, and this which will be explained in more detail in the following.

The longitudinal axis 85 of the hydraulic unit 32 is advantageously positioned so as to coincide with the longitudinal axis 11 of the housing part 2. The two bores 37, 38 in the hydraulic unit 32 are positioned advantageously on the side of the longitudinal axis 85 of the hydraulic unit 32 facing away from the reducing gear unit 21. The piston chamber 31 is positioned in the shown embodiment in a transverse center plane 29 of the hydraulic unit 32. The piston 28 is guided in a sealed way within the piston chamber 31 and serves to take in hydraulic medium from the hydraulic medium reservoir 33 and to supply it through the supply bore 38 to the pressing unit 40 by means of its reciprocating movement.

Figure 3:
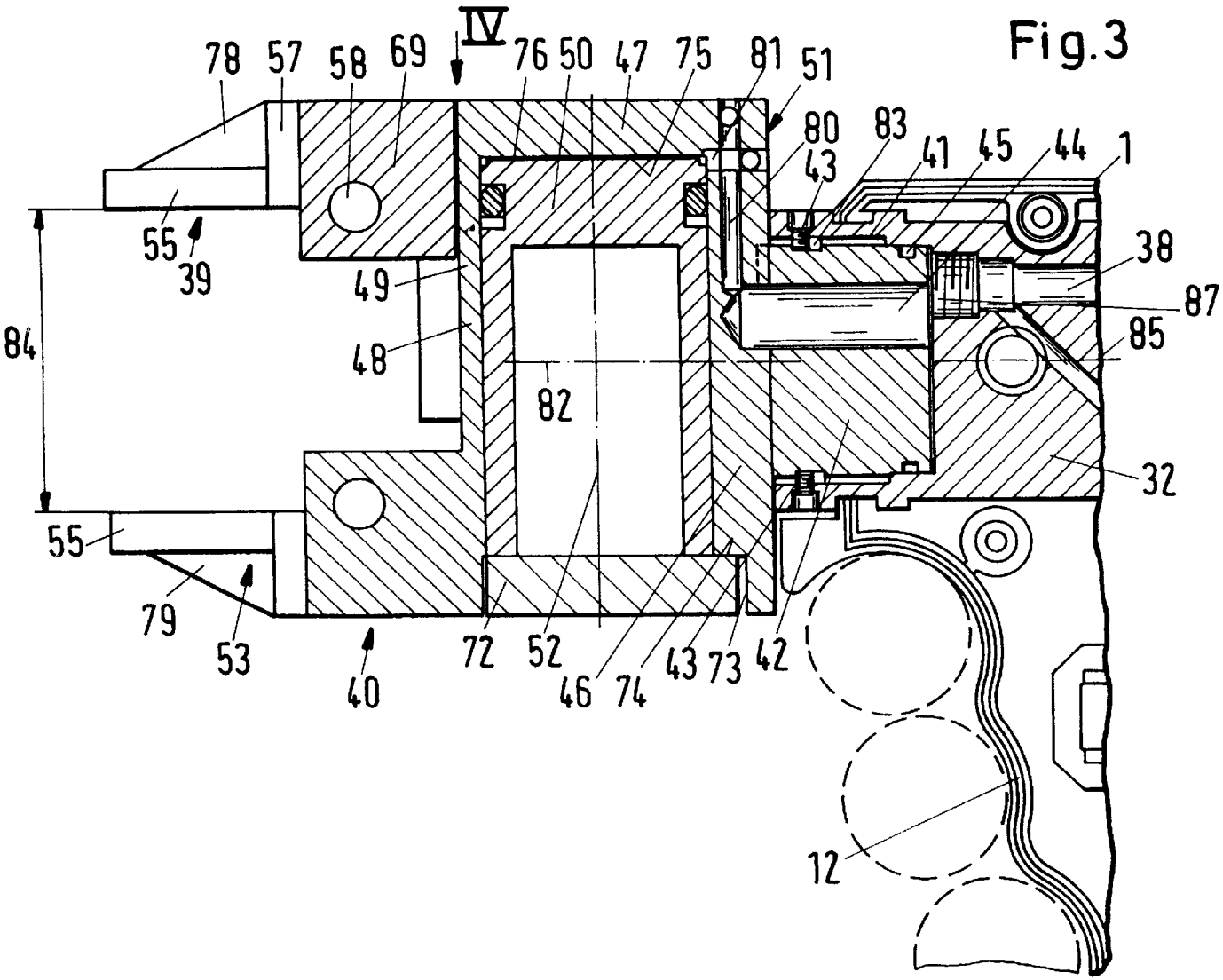
FIG. 3 is an enlarged representation in section of the pressing parts of the device according to FIG. 1 that are movable relative to one another.

The hydraulic unit 32, as illustrated in FIG. 3, has a recess 41 at its end facing away from the hydraulic medium reservoir 33 into which a projection 42 of the pressing unit 40 is inserted. The pressing unit 40 is detachably fastened by securing screws 43 in the recess 41 of the hydraulic unit 32. The projection 42 is penetrated axially by a bore 44 which is in flow connection with the supply bore 38 of the hydraulic unit 32 via an annular groove 87 when the pressing unit 40 is mounted. The projection 42 is sealed by at least one annular seal 45 relative to the inner wall of the recess 41 of the hydraulic unit 32 so that the hydraulic medium cannot exit to the exterior from the recess 41 of the hydraulic unit 32.

Figure 4:
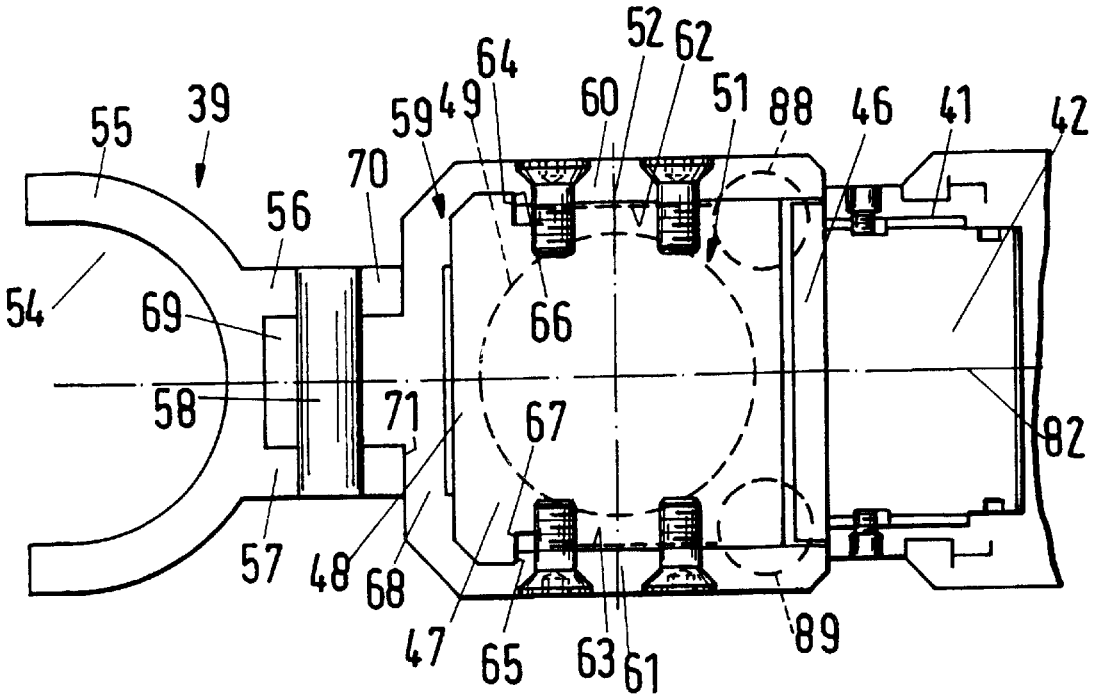
FIG. 4 is a view in the direction of arrow IV of FIG. 3.

The projection 42 projects centrally from a bottom 46 of the pressing unit 40. The bottom 46 is plate-shaped and extends in a plane that is transversely to the longitudinal axis 85 of the hydraulic unit 32. The end of the bottom 46 facing away from the grip 7 and the stay 12 is connected to a wall 47 projecting transversely thereto, wherein the bottom 46 and the wall 47 are preferably formed as a monolithic part. The wall 47 connects the bottom 46 with a wall 48 which extends parallel to the bottom 46 and which is advantageously also formed as a unitary (monolithic) part of the wall 47. The bottom 46 and the two walls 47, 48 are closed at their ends positioned above and below the plane of the drawing according to FIG. 3 by further walls. All walls form a monolithic part and delimit a centrally positioned cylinder chamber 49 (FIGS. 3 and 4) into which a drive element in the form of a piston 50 can be inserted in a seal-tight way. The bottom 46, the walls 47, 48 as well as the further walls connecting them thus form a drive element housing (piston housing) 51 in which a cylinder chamber 49 is defined. The drive element housing 51 has a rectangular, in particular, square contour, as can be seen in FIG. 4 when viewed in the direction of the axis 52 of the piston 50. The drive element housing 51 supports on the side facing away from the tool housing 1 a stationary pressing part 53 positioned opposite the other pressing part 39. The two pressing parts 39, 53 are identical but mirror-symmetrically arranged to one another. Accordingly, in the following only the pressing part 39 will be explained in more detail with the aid of FIG. 4.

The pressing part 39 is bracket-shaped and has an approximately half-cylindrical receptacle 54 for the workpiece to be pressed. The receptacle 54 is delimited, in a view according to FIG. 4, by an approximately semi-circular bracket 55 from which project two parallel legs 56, 57 which are connected to one another by a transverse bolt 58.

The two legs 56, 57 are connected by the transverse bolt 58 to a slide 59 which is U-shaped in the plan view according to FIG. 4. The slide 59 rests with flat legs 60, 61 against the parallel outer sides 62, 63 of the drive element housing 51 in areal engagement. The outer sides 62, 63 are provided with an outwardly oriented projection 64, 65 having coordinated therewith corresponding projections 66, 67 at the inner sides of the legs 60, 61 of the slide 59. The projections 64, 65; 66, 67 extend across the length of the outer sides 62, 63 and of the legs 60, 61. The projections ensure that the slide 59 cannot be removed transversely to the projections from the drive element housing 51.

The stay 68 of the slide 59 connecting the two legs 60, 61 rests against the wall 48 of the drive element housing 51. At half the width of the stay 68, the projection 69 extends away from the stay 68 at the side facing away from the housing 51 and engages between the two legs 56, 57 of the pressing part 39. It is penetrated by the transverse bolt 58. The legs 56, 57 rests against the outer sides of the projections 69. Moreover, the end faces 70, 71 of the two legs 56, 57 rest against the stay 68 of the slide 59. This prevents tilting or canting of the pressing part 39 relative to the slide 59.

The two legs 60, 61 of the slide 59 extend approximately over the entire length of the drive element housing 51. It is open at the side opposite the wall 47. It is closed by a plate-shaped support 72 (FIG. 3) which connects the free ends of the legs 60, 61 and to which is fastened the piston 50. The walls 46, 62, 63 of the drive element housing 51 delimit with their free ends a recess 73 which is engaged by the support 72 when the piston 50 is in the retracted position (FIG. 3). In this position, the support 72 contacts the bottom 74 of the recess 73. The piston surface 75 positioned opposite thereto and loadable by the hydraulic medium has in this position still a spacing from the bottom 76 of the cylinder chamber 49. This ensures that the hydraulic medium can still reach the piston surface 75 even when the piston 50 is completely retracted.

The projection 69 of the slide 59 extends, as is shown in FIG. 3, only over a portion of the height of the drive element housing 51. FIG. 3 shows the initial position of the pressing part 39 in which it has the greatest spacing from the oppositely positioned pressing part 53. In contrast to the pressing part 39, the pressing part 53 is rigid and preferably formed as a unitary (monolithic) part of the drive element housing (piston housing) 51. During the pressing action, the pressing part 39 is moved against the pressing part 53. The slide 59 ensures a proper, especially canting-free, guiding of the pressing part 39 on the piston housing 51.

The two brackets 55 of the pressing parts 39, 53 are provided at their sides facing away from one another with reinforcements 78, 79 which extend almost over the entire circumference of the brackets 55 and increase steadily from the bracket ends in the direction toward the projection 69. Accordingly, the reinforcements 78, 79 have a triangular contour transverse to the direction of movement of the pressing part 39 (FIG. 3). Because of these reinforcements 78, 79 very high pressing forces can be applied without the risk of unacceptable deformation of the brackets 55 of the pressing parts 39, 53.

In order to guide the hydraulic medium into the cylinder chamber 49, the bore 44 (FIG. 3) extends into the wall 46 of the piston housing 51. The end of the bore 44 positioned in this wall 46 is connected to a bore 80 which extends transversely thereto in the wall 46 and leads to the outer side of the wall 47 of the piston housing 51. The bore 80 can thus be easily produced in this configuration in the piston housing 51. The bore 80 is closed with respect to the outer side of the wall 47. The connection of the bore 80 with the cylinder chamber 49 is realized by a further bore 81 which projects from the outer side of the wall 46 of the piston housing 51 into the cylinder chamber 49. Accordingly, this bore 81 can also be produced with a simple manufacturing process. The bore 81, which extends transversely to the bore 80, is closed relative to the outer side of the housing wall 46.

The pressing unit 40 can be rotated about the axis 82 of its projection 42. For this purpose, the outer side of the cylindrical projection 42 is provided with an annular groove 83 which is engaged by securing screws 43. This secures the pressing unit 40 against lifting off the tool housing 1 but allows a continuous rotation about the axis 82. This has the advantage that the pressing parts 39, 53 can be rotated into the optimal position for the pressing action.

At the begin of the pressing action the pressing part 39 is advantageously in the initial position illustrated in FIGS. 2 and 3. The two brackets 55 of the pressing parts 39, 53 are positioned parallel to one another. An axial pressing technique is performed by the pressing unit 40, such pressing technique being known in general. For example, a pressing ring and a squeeze ring are slipped onto a pipe into which a support sleeve has been inserted. The pressing ring is then pressed with the aid of the pressing unit 40 axially across the squeeze ring until it reaches the stop on the support sleeve (fitting). This axial movement of the pressing ring results in a radial pressing action. The pipe is inserted such into the two pressing parts 39, 53 that the pressing ring to be moved is arranged between the two pressing parts 39, 53 and rests with one end against the pressing part 39. When the pressing part 39 is moved in the direction of the pressing part 53, the forked bracket 55 of the pressing part 39 entrains the pressing ring and moves it across in the squeeze ring positioned on the pipe until the pressing ring contacts the support sleeve. The support sleeve then rests axially against the fork 55 of the pressing part 53.

In order to move the pressing part 39, the motor 17 is turned on by means of the switch 15. The high rotational speed of the motor shaft 20 is reduced by the reducing gear unit 21 into a correspondingly low rotational speed of the drive shaft 23 of the reducing gear unit 21. The eccentric piece 24 seated on the drive shaft 23 thus performs an eccentric movement. The elliptical ring 26 is reciprocated in the direction of arrow 27 (FIG. 2) so that the piston 28 in the piston chamber 31 of the hydraulic unit 32 is accordingly reciprocated also. When the piston 28 moves downwardly from the position illustrated in FIG. 2, it takes in hydraulic medium via the check valve 36 and the bore 37 from the hydraulic medium reservoir 33. When the piston 28 is moved upwardly, the hydraulic medium, which is present in the bore 37 as well as in the piston chamber 31, is pressurized and conveyed via the bores 38, 44, 80, 81 into the cylinder chamber 49. The piston 50 is thus pressurized so that it is moved from the position according to FIGS. 2 and 3 in the downward direction. By means of the support 72 and the slide 59 connected thereto the pressing part 39 is moved in the direction of the oppositely positioned pressing part 53. The fork 55 of the pressing part 39 entrains the pressing ring and moves it across the squeeze ring. The piston 28 in the hydraulic unit 32 is continuously reciprocated by the rotation of the eccentric piece 24 and, in the afore described manner, conveys the hydraulic medium into the cylinder chamber 49 and thus continuously moves the piston 50 positioned therein in the downward direction. As soon as the pressing ring contacts the support sleeve, the motor 17 is advantageously automatically turned off. The point in time for turning it off can be determined simply in that t the point of contact of the pressing ring on the support sleeve the pressure required for a further movement of the pressing part 39 increases suddenly so that this pressure increase is detected and used for turning off the motor 17. At the same time, this pressure increase opens the pressure limit valve (not shown) so that the hydraulic medium can flow back from the piston chamber 49 by a return bore (not shown) to the hydraulic medium reservoir 33. This return flow is initiated by the piston 50 being returned by a spring force into its initial position according to FIG. 3. FIG. 4 shows two pressure springs S1, S2 which are positioned partially in the drive element housing 51 and are supported on the legs 60, 61 of the slide 59. The pipe can be removed easily in a direction transversely to the movement direction of the pressing part 39 from the pressing unit 40.

The described device is very compact and also lightweight. The tool housing 1 with the drive 4 arranged therein, the piston 50 and the pressing part 39 are positioned in series when viewed in a direction transverse to the movement direction of the pressing part 39. This results in a compact configuration and especially in an optimal weight distribution of the device. It is not top heavy so that it can be held by the user during the pressing action and also thereafter comfortably. The device ensures a simple manipulation and handling.

An important feature of this device is also to be seen in that the axis 82 of the projection 42 which is a coupling member of the pressing unit 40 extends through the range of maximum travel 84 (FIG. 3) of the pressing part 39. The two pressing parts 39, 53 are thus positioned at least partially on either side of the axis 82 of the projection 42 which results in an excellent weight distribution.

The coupling member in the form of the projection 42 ensures an optimal connection to the hydraulic unit 32, in particular, since the bore 44 is provided in the projection 42 which, after coupling, provides communication with the bore 38 provided in the hydraulic unit 32 via the annular groove 87. Accordingly, no hoses or tubes are required as connecting pieces for conveying the hydraulic medium from the hydraulic medium reservoir 33 to the pressing unit 40. Instead, the conveying of the hydraulic medium is realized exclusively via bores provided within the device so that the problem of leakage is at least reduced. Since the device has no external hoses etc., the pressing action is considerably simplified because the user must not pay attention to externally positioned connecting hoses.

The piston 50 is positioned transversely to the axis 82 of the projection 42. This position results also in an excellent weight distribution which ensures an optimal handling of the device.

Since the pressing unit 40 can be rotated, it can be adapted on site by a corresponding rotational movement to the parts to be pressed. For example, it is thus possible to press with the pressing unit 40 also already mounted pipes wherein in such situations the pressing unit 40 can be easily adapted to the given position of the mounted pipes etc.

A further important feature of the device is to be seen in that the pressing unit 40 can be rotated about the axis 82 of the projection 42. Advantageously, the axis 82 is positioned at least in approximation in a symmetry plane of the pressing unit 40, relative to the initial position of the pressing part 39 illustrated in FIG. 3. With this configuration the weight distribution upon rotation of the pressing unit 40 is not changed or changed only insignificantly. Accordingly, the device can be held optimally in any position of the pressing unit 40.

The axis 82 of the projection 42 is positioned preferably so as to coincide with the axis 85 of the hydraulic unit 32 which coincides, in turn, advantageously with the longitudinal axis 11 of the housing part 2. This also ensures an excellent weight distribution which results in a simple handling of the device during the pressing action.

Figure 5:
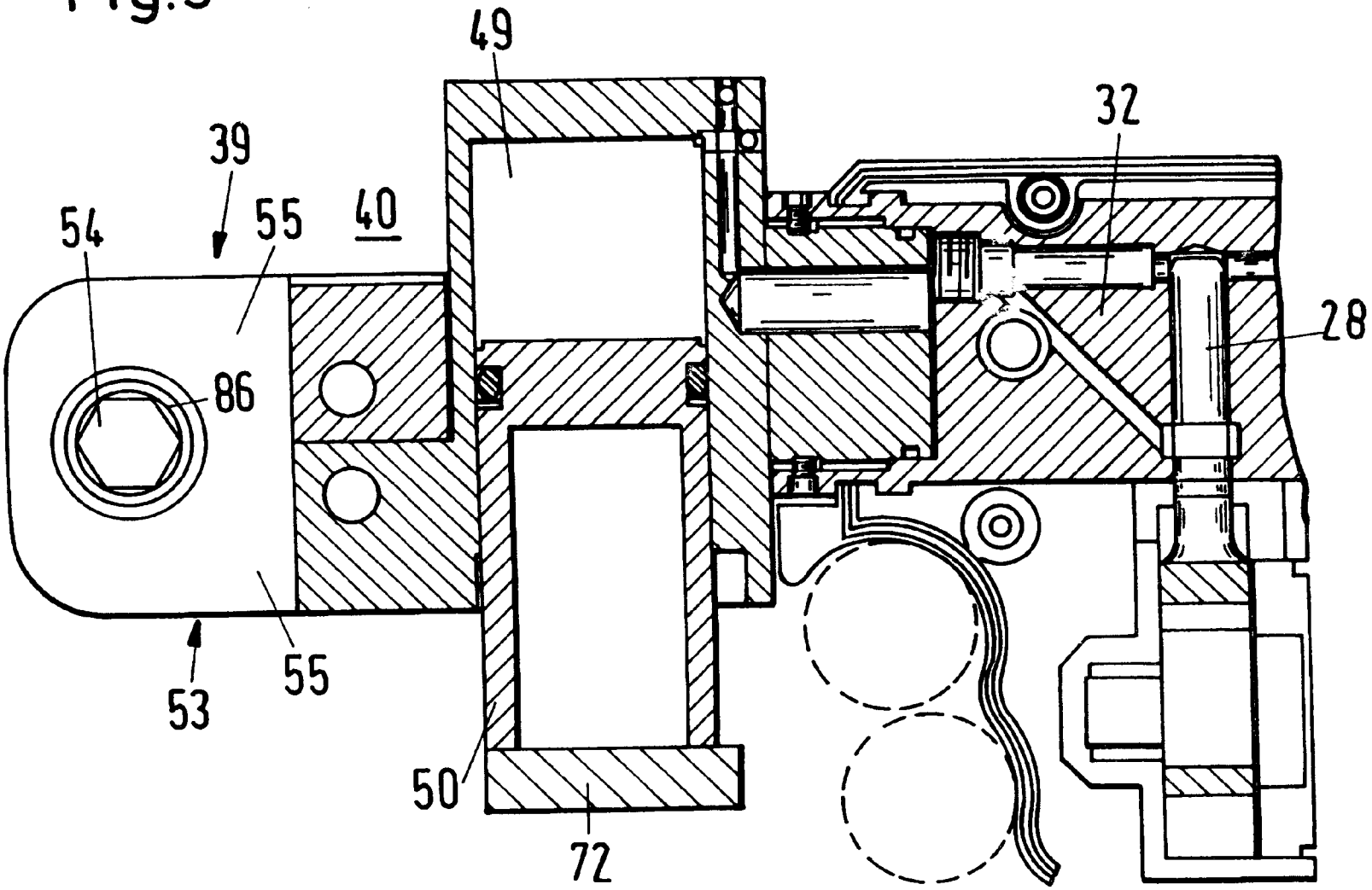
FIG. 5 is a sectional view of a portion of a second embodiment of the device according to the invention for pressing work pieces.

FIG. 5 shows an embodiment in which the pressing parts of the pressing unit perform a radial pressing action. In this case, the two pressing parts 39, 53 of the pressing unit 40 are rotated by 90° relative to one another in comparison to the previous embodiment, so that the receptacles 54 of its two forks 55 are oriented against one another. FIG. 5 shows the end position of the pressing part 39 in which its fork rests at the fork 55 of the stationary pressing part 53. The pressing part 39, as in the previous embodiment, is fixedly connected to the slide of which only the support 72 is shown in FIG. 5 which supports the piston 50. The device of this embodiment is otherwise identical to the previous embodiment.

For a radial pressing action, the receptacle 54 of the pressing part 53 receives the respective pipe or pipe piece. At the beginning of the pressing action, the piston 50 is retracted so that the pressing part 39 is positioned at a corresponding spacing to the pressing part 53. As has been explained in detail with the previous embodiment, the piston 28 is continuously reciprocated in the hydraulic unit 32 thus conveys the hydraulic medium into the cylinder chamber 49 so that the piston 50 is moved downwardly in FIG. 5. The pipe, pipe piece, support sleeve etc. in the receptacle 54 of the pressing part 53 is thus radially pressed. FIG. 5 shows the workpiece 86 radially pressed by the two pressing parts 39, 53.

This embodiment also provides the same advantages as the previously described embodiment.

The two embodiments are each embodied as an electro-hydraulic tool wherein one pressing part 39 is moved by being loaded with hydraulic medium via the piston 50. In a simpler embodiment (not shown) the movement of the pressing part 39 can also be mechanically achieved, for example, by a spindle drive. In this case, a hydraulic medium is not required. In this case, the motor 17 drives by means of the reducing gear unit 21 the spindle drive by which the pressing part 39 is then moved relative to the other pressing part 53.

Figure 6:
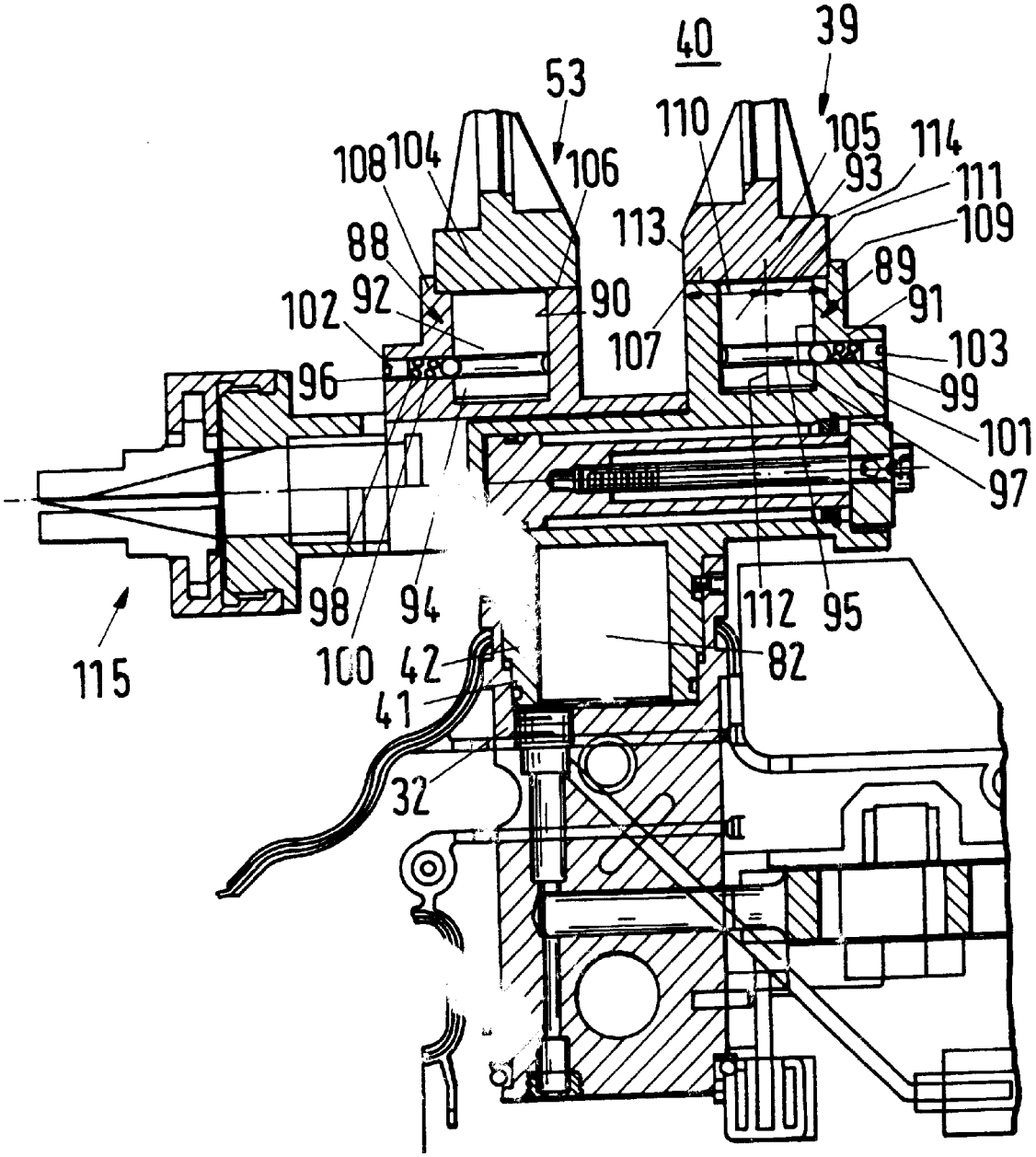
FIG. 6 is a sectional view of a part of a third embodiment of the device according to the invention for pressing work pieces.
Figure 7:
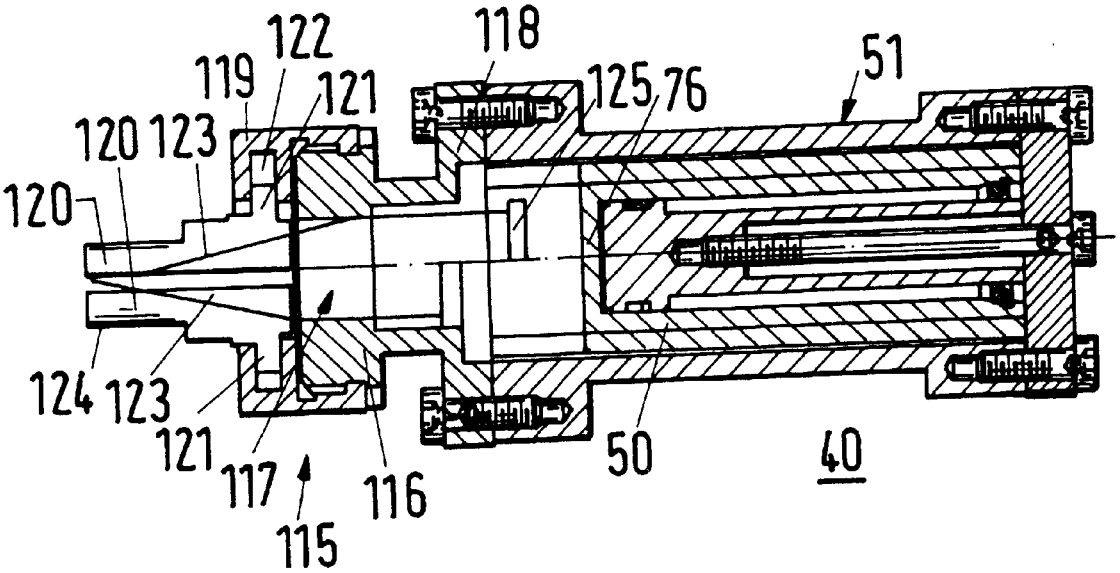
FIG. 7 is an enlarged representation, rotated 90° relative to the illustration of FIG. 6, of the pressing unit of the device according to FIG. 6.
Figure 8:
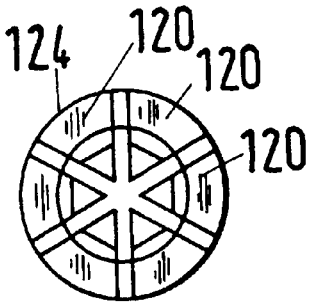
FIG. 8 is an end view of the widening device of the device according to FIG. 6.

FIGS. 6 through 8 show a device which, in accordance with the previous embodiments, is also embodied as an electro-hydraulic portable tool. The two pressing parts 39, 53 of the pressing unit 40 are provided for realizing an axial pressing action. The drive of the pressing parts 39, 53 is realized in the same manner as in the embodiment according to FIGS. 1 through 4. The pressing unit 40 has the projection 42 which engages the recess 41 of the hydraulic unit 32. In the housing 51 of the pressing unit 40 the piston 50 is reciprocatingly movable by means of a hydraulic medium, as has been disclosed in connection with the embodiment according to FIGS. 1 through 4. The pressing parts 39, 53 are secured exchangeably in corresponding receptacles 88, 89, as in the previous embodiments. They have cylindrical receptacle chambers 90, 91 which receive cylindrical pins 92, 93 of the pressing parts 39, 53 in a positive-locking manner. The cylindrical pins 92, 93 are provided with annular grooves 94, 95 in a radial plane. The grooves 94, 95 are engaged by catch elements 96, 97, preferably in the form of catch balls. They are loaded by coil springs 98, 99 which are secured in transverse bores 100, 101 of the receptacles 89, 88. For securing the catch elements 96, 97 the transverse force 100, 101 are closed by locking screws 102, 103. In the mounted position the pressing parts 39, 53 rest with a base member 104, 105 on the end faces 106,107 of the receptacles 88, 89.

The pressing parts 39, 53 are advantageously of a monolithic configuration. Since the cylindrical pins 92, 93 of the pressing parts 39, 53 are cylinder-shaped, they can be manufactured in a simpler and less expensive manner in comparison to conventional pressing parts. In conventional pressing parts, the insertion projection is comprised of a rectangular projection part connected to the base member and a cylindrical projection part connected to the rectangular part. This results in a complicated and expensive manufacture of these pressing parts. The annular grooves 94, 95 can also be easily and inexpensively provided on the pins 92, 93. Moreover, it is advantageous that the catch elements are positioned in the receptacles 88, 89 of the tool instead of on the pressing parts themselves, as is conventional in the prior art. Thus, only two catch elements 96, 97 are required in order to secure pressing parts 39, 53 of different configurations in the receptacles 88, 89. Since the pressing parts 39, 53 have as an insertion projection only the pins 92, 93, they can have a relatively large diameter so that also great forces can be received during the pressing action.

Advantageously, the receptacles 88, 89 are provided with supports 108,109 for the pressing parts 39, 53. The supports 108,109 are provided such on the receptacles 88, 89 that the pressing parts 39, 53 are supported on these supports with respect to the reaction force occurring during the pressing action. This results in a favorable force transmission during the pressing action. The supports 108, 109 are advantageously ledge-shaped and project from the end faces 106, 107 of the receptacles 88, 89. The pressing parts 39, 53 are positioned with their base members 104,105 on the supports 108, 109 which are advantageously formed as monolithic parts of the receptacles 88, 89.

Depending on the size of the workpieces to be pressed, differently sized pressing parts 39, 53 can be inserted into the receptacles 88, 89. The pins 92, 93 are relatively short so that the pressing parts 39, 53 have a compact configuration which also results in a favorable force introduction and force transmission.

The pins 92, 93 are positioned eccentrically relative to the base members 104, 105. The spacing 110, 111 (FIG. 6) between the axis 112 of the pins 92, 93 and the oppositely positioned outer sides 113, 114 of the base members 104, 105 of the pressing parts 39, 53 are different. This has the advantage that the pressing parts 39, 53 cannot be inserted side-inverted into the receptacles 88, 89.

The pressing parts 39, 53 are otherwise of identical configuration as in the embodiment according to FIGS. 1 through 4. The workpieces to be axially pressed relative to one another are inserted in the above disclosed manner into the pressing parts 39, 53. Subsequently, by actuation of the switch 15 (FIGS. 1 and 2) the motor 17 (FIG. 2) is turned on so that the two pressing parts 39, 53 are moved relative to one another to perform the axial pressing action. As in the embodiment according to FIGS. 1 through 4, the axis 82 of the projection 42 extends through the range of maximum travel of the pressing part 39. The two pressing parts 39, 53 are thus positioned at least partially on either side of the axis 82 of the projection 42 so that an optimal weight distribution results.

A pipe widening device 115 can be connected to the pressing unit 40. It has a pipe widening housing 116 (FIG. 7) that is open on both ends and in which a widening mandrels 117 is arranged in a manner known in the art. The housing 116 has a radially outwardly oriented flange 118 at a side facing the pressing unit 40 via which the pipe widening device 115 can be detachably fastened to the pressing unit 40. The axis of the pipe widening device 115 coincides with the axis of the piston 50.

Onto the end of the housing 116 facing away from the pressing unit 40 a nut 119 can be screwed which contains widening segments 120. As is illustrated in FIG. 8, six widening segments 120 are provided which in the retracted position of the widening mandrels 117 rest with their lateral surfaces against one another. The widening segments 120 engage with radially outwardly projecting stays 121 an annular chamber 122 which is provided on the inner side of the nut 119. The annular chamber 122 is of such a radial width that the widening segments 120 during the widening process can be moved sufficiently far radially outwardly. The widening segments 120 are axially secured in the annular chamber 122.

FIG. 7 shows the upper half of the widening mandrel 117 in a retracted position in which the widening segments 120 are resting against one another, as is known in the prior art. The lower half of FIG. 7 shows the widening mandrel 117 in the extended position. The widening segments 120 are radially moved outwardly when the widening mandrel is extended so that the pipe placed onto the widening segments 120 is radially widened. The widening segments 120 are provided at their inner side with a conical surface 123 with which the widening segments 120 rests against the conical widening mandrel 117. At their outer side the widening segments 120 are provided, in a manner known in the art, with partial cylindrical surfaces 122 which during the widening process rests against the inner side of the pipe to be widened.

With this optional pipe widening device 115 it is thus possible to widen, if needed, pipes before the pressing action. For this purpose, the pipe is positioned with its one end on the widening segments 120. Subsequently, by actuating the switch 15, the motor 17 is turned on so that the piston 50 is moved in the manner described in connection with FIGS. 1 through 4. The bottom 76 of the piston 50 upon movement contacts the plate-shaped end piece 125 of the widening mandrel 117. It is thus moved away from its initial position (upper half of FIG. 7) so that the widening segments 120 are radially outwardly moved and the pipe end is widened. As soon as the widening process is completed, the motors 17 is turned off. The piston 50 is then returned in the afore described manner by a spring force into its initial position. The widening mandrel 117 is also advantageously loaded by a spring force so that, upon return of the piston 50, the widening mandrel 117 is also returned into its initial position. The widening segments 120 are also loaded by a spring force so that the widening segments 120 upon return of the widening mandrel 117 are radially retracted.

After the widening process, the pipe is removed and slipped onto a support sleeve of a fitting which is inserted into the corresponding pressing part 39 or 53. The pressing sleeve to be pressed with the fitting and already pushed onto the pipe is inserted into the other pressing part. It is pressed axially by the pressing unit in the afore described manner onto the wide end supported on the support sleeve.

Depending on the inner diameter of the pipe to be widened, nuts 119 with corresponding widening segments 120 can be screwed onto the housing 116 of the pipe widening device 115. Moreover, the user of the device, if the pipe widening device 115 is not needed, can remove it at any time from the pressing unit 40.

While specific embodiments of the invention have been shown and described in detail to illustrate the inventive principles, it will be understood that the invention may be embodied otherwise without departing from such principles.

What is claimed is:

1. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

wherein said drive element (50) has a drive element housing (51) and wherein said pressing unit (40) comprises a slide (59), said slide (59) configured to be guided externally on said drive element housing (51) in a direction of travel, wherein said at least one pressing part (39, 53) is connected to said slide (59).

2. The electric tool according to claim 1, wherein said slide (59) is secured on said drive element housing (51) against movement in a direction transverse to said direction of travel.

3. The electric tool according to claim 1, wherein said drive element (50) is a piston configured to be loaded by a pressure medium and wherein said slide (59) is connected to said piston (50).

4. The electric tool according to claim 1, wherein said drive element is a spindle.

5. The electric tool according to claim 1, wherein said pressing unit (40) is configured to perform an axial or radial pressing action.

6. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

wherein said drive element (50) has a drive element housing (51) and wherein said pressing unit (40) comprises a slide (59), said slide (59) configured to be guided on said drive element housing (51) in a direction of travel, wherein said at least one pressing part (39, 53) is connected to said slide (59);

wherein said slide (59) is positioned on an exterior of said drive element housing (51) and at least partially embraces said drive element housing (51).

7. The electric tool according to claim 6, wherein said slide (59) is U-shaped viewed in said direction of travel and has legs (60, 61) configured to be guided on opposite outer sides of said exterior.

8. The electric tool according to claim 7, comprising a support (72) on which said drive element (50) is seated, wherein said support (72) is connected to said legs (60, 61).

9. The electric tool according to claim 8, wherein said support (72) is configured to limit a travel stroke of said at least one pressing part (39) in a direction of movement of said at least one pressing part (39) and defines a first end position of said at least one pressing part (39), wherein said drive element housing (51) has a stop and said support (72) rests against said stop in said first end position of said at least one pressing part (39).

10. The electric tool according to claim 9, wherein said support (72) is retracted into said drive element housing (51) in said first end position of said at least one pressing part (39).

11. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

wherein said drive (4) comprises a hydraulic unit (32) and wherein said pressing unit (40) has at least one connecting piece (42) configured to be connected to said hydraulic unit (32), wherein said hydraulic unit (32) comprises a hydraulic supply conduit (44) extending though said connecting piece (42) and configured to supply a hydraulic medium to said drive element (50).

12. The electric tool according to claim 11, wherein said at least one connecting piece (42) is positioned transversely to said drive element housing (51) and wherein said at least one connecting piece (42) has a longitudinal axis (82) extending transversely to said direction of movement of said at least one pressing part (39).

13. The electric tool according to claim 11, wherein said at least one connecting piece has a longitudinal axis (82) located within a range of maximum travel of said at least one pressing part (39).

14. The electric tool according to claim 13, wherein in said first end position of said at least one pressing part (39) said longitudinal axis (82) extends approximately centrally between said two pressing parts (39, 53).

15. The electric tool according to claim 11, wherein said at least one connecting piece (42) is a coupling member coupled to said hydraulic unit (32), wherein by coupling said coupling member to said hydraulic unit (32) a drive connection is established between said drive (4) and said pressing unit (40).

16. The electric tool according to claim 11, wherein said at least one connecting piece has a longitudinal axis (82) and wherein said drive element (50) has a central axis (52) extending transversely to said longitudinal axis (82).

17. The electric tool according to claim 11, wherein said connecting piece (42) is configured to be connected to said hydraulic unit (32) so as to be rotatable about said longitudinal axis (82).

18. The electric tool according to claim 11, wherein said tool housing (1) is comprised of two housing parts (2, 5) extending parallel to one another and having a transition into one another.

19. The electric tool according to claim 18, wherein a first one of said two housing parts (5) projects past a second one of said two housing parts (2) at a side of said tool housing (1) remote form said pressing unit (40).

20. The electric tool according to claim 18, wherein said tool housing (1) comprises a grip (7) and wherein said grip (7) is transversely connect to one of said two housing parts (5).

21. The electric tool according to claim 20, wherein said grip (7) and said two housing parts (2,5) are formed as a monolithic part.

22. The electric tool according to claim 18, wherein said hydraulic unit (32) is positioned in a first one of said two housing parts (2), wherein said hydraulic unit (32) comprises at least one hydraulic medium reservoir (33), and wherein said at least one hydraulic medium reservoir (33) is located in said first one of said two housing parts (2).

23. The electric tool according to claim 22, wherein said hydraulic unit (32) comprises at least one pump element (28).

24. The electric tool according to claim 21, wherein said at least one pump element (28) is a reciprocating piston (28), wherein said hydraulic unit (32) comprises a piston chamber (31) configured to receive said reciprocating piston (28), and wherein said piston chamber (31) has a connection (37) to said at least on hydraulic medium reservoir (33).

25. The electric tool according to claim 22, wherein said at least one hydraulic medium reservoir (33) comprises at least one check valve (36) configured to close off said connection (37) to said piston chamber (31), wherein said check valve (36) is configured to open when said reciprocating piston (28) performs an intake stroke and to close when said reciprocating piston (28) performs a pressure stroke.

26. The electric tool according to claim 23, wherein said hydraulic unit (32) comprises an eccentric drive (23, 24, 26) configured to act on said pump element (28) for reciprocating said pump element (28), wherein said eccentric drive (23, 24, 26) is positioned in a second one of said two housing parts (45).

27. The electric tool according to claim 26, wherein said hydraulic unit (32) and said eccentric drive (23, 24, 26) are positioned atop one another.

28. The electric tool according to claim 26, wherein said eccentric drive (23, 24, 26) is positioned between said hydraulic unit (32) and a grip (7) of said tool housing (1).

29. The electric tool according to claim 26, wherein said electric motor (17) comprises a reducing gear unit (21) and is drivingly connected to said eccentric drive (23, 24, 26) via said reducing gear unit (21).

30. The electric tool according to claim 29, wherein said reducing gear unit is a planetary gear unit (21).

31. The electric tool according to claim 29, wherein said electric motor (17), said reducing gear unit (21), and said eccentric drive (23, 24, 26) are axially connected to one another in series.

32. The electric tool according to claim 29, wherein said electric motor (17), said reducing gear unit (21), and said eccentric drive (23, 24, 26) are coaxially connected to one another in series.

33. The electric tool according to claim 23, wherein a movement of said at least one pump element (28) is parallel to said direction of movement of said at least one pressing part (32).

34. The electric tool according to claim 11, wherein said hydraulic unit (32) and said connecting piece (42) are positioned coaxially adjacent to one another.

35. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

wherein said two pressing parts (39, 53) each have a cylindrical pin (92, 93) with an annular groove (94, 95) and wherein said pressing unit (40) has catch elements (96, 97) engaging said annular groove (94, 95), respectively.

36. The electric tool according to claim 35, wherein said pressing unit (40) comprises two receptacles (88, 89) for said two pressing parts (39, 53), wherein said receptacles (88, 89) have receiving bores (100, 101) configured to receive said catch elements (96, 97).

37. The electric tool according to claim 36, wherein said pressing unit (40) comprises a slide (59), wherein a first one of said two receptacles (88, 89) is connected to said slide (59) and wherein a second one of said two receptacles (88, 89) is connected to said drive element housing (51).

38. The electric tool according to claim 35, wherein said catch elements (96, 97) are spring-loaded balls.

39. The electric tool according to claim 35, wherein said pressing parts (39, 53) each have a base member (104, 105) and wherein said cylindrical pins (96, 97) project form said base members (104, 105).

40. The electric tool according to claim 39, wherein said pressing parts (39, 53), comprised of said base members (104, 105) and said cylindrical pins (96, 97), respectively, are formed as monolithic parts.

41. The electric tool according to claim 39, wherein said cylindrical pins (92, 93) each have a central axis (112) positioned eccentrically on said base members (104, 105) and being spaced at different spacings (110, 111) to oppositely positioned sidewalls (113, 114) of said base members (104, 105) extending parallel to said central axis.

42. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

wherein said pressing unit (40) comprises two receptacles (88, 89) configured to receive said two pressing parts (39, 53), wherein said pressing parts (39, 53) are supported during a pressing action against a reaction force on at least one support (108, 109) provided on each one of said receptacles (88, 89).

43. The electric tool according to claim 42, wherein said at least one support (108, 109) is a ledge on said receptacles (88, 89) projecting from an end face (106, 107) of said receptacles (88, 89).

44. The electric tool according to claim 43, wherein said ledge is a monolithic parts of said receptacles (108, 109).

45. The electric tool according to claim 42, wherein said pressing parts (39, 53) have base members (104, 105) resting against said supports (108, 109).

46. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

further comprising at least one pipe widening device (115) connected to said pressing unit (40).

47. The electric tool according to claim 46, wherein said pipe widening device has a pipe widening housing (116) and a widening mandrel (117) arranged axially slidable in said pipe widening housing (116).

48. The electric tool according to claim 47, wherein said pipe widening device (115) has widening segments (120) configured to be radially moveable by said widening mandrel (117).

49. The electric tool according to claim 48, wherein said pipe widening device (115) comprises a nut (119) configured to be screwed onto said pipe widening housing (116) and to house said widening segments (120).

50. The electric tool according to claim 47, wherein said widening mandrel (117) is configured to be moveable by said drive element (50) against a spring force.

51. The electric tool according to claim 47, wherein said pipe widening device (115) is configured to be screwed onto said pressing unit (40).

52. The electric tool according to claim 47, wherein said pipe widening device has a central axis coinciding with a central axis of said drive element (50).

53. An electric tool for applying a pressing force, said tool comprising:

a tool housing (1);

a drive (4) arranged in said tool housing (1);

said drive (4) comprising an electric motor (17) and a drive element (50) configured to be driven by said electric motor (4), wherein said drive element (50) is located externally to said tool housing (1);

a pressing unit (40) connected to said drive element (50) remote from said tool housing (1) and comprising two pressing parts (39, 53); and said drive element (50) configured to act on at least one of said two pressing parts (39, 53) for moving said at least one pressing part (39, 53) relative to the other one of said two pressing parts (39, 53);

wherein said pressing unit (40) has at least one connecting piece (42) configured to be connected to a hydraulic unit (32) of said drive (4).

54. The electric tool according to claim 53, wherein said at least one connecting piece (42) has a longitudinal axis (82) located within a range of maximum travel of said at least one pressing part (39).

55. The electric tool according to claim 53, wherein said at least one connecting piece (42) has a longitudinal axis (82) and wherein said drive element (50) has a central axis (52) extending transversely to said longitudinal axis (82).

* * * * *